US009770924B2

(12) United States Patent
Mutschall

(10) Patent No.: US 9,770,924 B2
(45) Date of Patent: Sep. 26, 2017

(54) SHEET-FED PRINTING MACHINE AND PRINTING UNIT IN A SHEET-FED PRINTING MACHINE

(71) Applicant: HEIDELBERGER DRUCKMASCHINEN AG, Heidelberg (DE)

(72) Inventor: Stefan Mutschall, Oestringen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/133,439

(22) Filed: Apr. 20, 2016

(65) Prior Publication Data

US 2016/0303875 A1 Oct. 20, 2016

(30) Foreign Application Priority Data

Apr. 20, 2015 (DE) ..... 10 2015 207 136

(51) Int. Cl.
*B41J 11/04* (2006.01)
*B41J 13/00* (2006.01)

(52) U.S. Cl.
CPC ..... *B41J 11/04* (2013.01); *B41J 13/0009* (2013.01)

(58) Field of Classification Search
CPC ..... B41F 21/104; B41F 21/04; B41F 21/05; B41F 21/06; B41F 21/10; B41J 13/223; B65H 29/68; B65H 5/12; B65H 2513/20
See application file for complete search history.

(56) References Cited

U.S. PATENT DOCUMENTS 3,884,146 A * 5/1975 Ruetschle ..... B41F 21/108 101/183
4,290,595 A * 9/1981 Thunker ..... B41F 21/10 101/246
4,660,825 A * 4/1987 Umezawa ..... B41L 29/14 271/276
5,531,433 A * 7/1996 Hawkes ..... B65H 5/12 271/10.01
6,912,952 B1 * 7/2005 Landa ..... G03G 15/234 101/229

(Continued)

FOREIGN PATENT DOCUMENTS

DE 202004018313 U1 1/2005
DE 102008051094 A1 4/2010

(Continued)

*Primary Examiner* — Stephen Meier
*Assistant Examiner* — John P Zimmermann
(74) *Attorney, Agent, or Firm* — Laurence A. Greenberg; Werner H. Stemer; Ralph E. Locher

(57) ABSTRACT

A printing unit in a sheet-fed printing machine includes a printing cylinder, an upstream transfer cylinder and a downstream transfer cylinder. The transfer cylinders each include a device for decelerating/accelerating a sheet. The device, in particular, includes at least one gripper bar being movable in a substantially radial direction to change the tangential speed of the gripper bar and thus of the sheet. A printing unit of this construction allows the sheets to be transported at a lower speed and at a shorter distance from one another during the printing process, resulting in a better print quality and a higher throughput of the machine. A sheet-fed printing machine including such a printing unit is also provided.

15 Claims, 5 Drawing Sheets

(56) References Cited

U.S. PATENT DOCUMENTS

| | | | | |
|---|---|---|---|---|
| 7,455,401 | B2 | 11/2008 | Koto et al. | |
| 7,841,595 | B2 * | 11/2010 | Massoud | B65H 1/06 271/100 |
| 8,356,812 | B2 * | 1/2013 | Moehringer | B41F 21/04 271/227 |
| 8,579,286 | B2 | 11/2013 | Hirai et al. | |
| 8,899,584 | B2 | 12/2014 | Kondo et al. | |
| 2005/0155503 | A1 * | 7/2005 | Onuma | B41F 7/06 101/177 |
| 2006/0239733 | A1 * | 10/2006 | Choi | G03G 15/6567 399/396 |
| 2008/0128982 | A1 | 6/2008 | Eidam et al. | |
| 2009/0284561 | A1 | 11/2009 | Fukui | |

FOREIGN PATENT DOCUMENTS

| | | | |
|---|---|---|---|
| EP | 2657036 | A1 | 10/2013 |
| WO | 2005028206 | A1 | 3/2005 |

* cited by examiner

SHEET-FED PRINTING MACHINE AND PRINTING UNIT IN A SHEET-FED PRINTING MACHINE

CROSS-REFERENCE TO RELATED APPLICATION

This application claims the priority, under 35 U.S.C. §119, of German Patent Application DE 10 2015 207 136.7, filed Apr. 20, 2015; the prior application is herewith incorporated by reference in its entirety.

BACKGROUND OF THE INVENTION

Field of the Invention

The invention relates to a printing unit in a sheet-fed printing machine including a printing cylinder, an upstream transfer cylinder and a downstream transfer cylinder. The invention further relates to a sheet-fed printing machine having the printing unit.

The use of digital printing machines to print short runs or customized printed images on paper, paperboard and cardboard has become known in the art. When inkjet heads are used to print on the sheets, a transport system passes a respective sheet underneath the inkjet heads at a minimum distance. Known transport systems are revolving transport belts, for instance embodied as suction belts, and rotating cylinders, also known as jetting cylinders, or revolving tables as described in U.S. Pat. No. 8,579,286 B2, for instance.

Machine concepts that use cylinders as described, for instance, in U.S. Patent Application Publication US 2009/0284561A1 include a number of inkjet print heads disposed above a jetting cylinder to print on sheets that are moved past at a short distance from the print heads. One jetting cylinder may simultaneously hold a plurality of sheets by suction and may transport them. In order to ensure good printing quality and to avoid damage to the print heads, it is important to ensure that a respective sheet rests securely on the jetting cylinder.

The printing speed of the inkjet print heads imposes a limit to increasing the throughput of the digital printing machine by increasing the rotary printing speed. In addition, the quality of the print suffers as the speed of the sheets to be printed increases.

SUMMARY OF THE INVENTION

It is accordingly an object of the invention to provide a sheet-fed printing machine and a printing unit in a sheet-fed printing machine, which overcome the hereinafore-mentioned disadvantages of the heretofore-known devices of this general type and which attain a higher throughput without suffering from diminished print quality.

With the foregoing and other objects in view there is provided, in accordance with the invention, a printing unit in a sheet-fed printing machine comprising a printing cylinder for holding sheets to be printed and for transporting them at a printing speed, as well as a transfer cylinder disposed upstream as viewed in the direction of transport, and a transfer cylinder disposed downstream as viewed in the direction of transport. In accordance with the invention, the upstream transfer cylinder has a device for decelerating a sheet from a machine speed to a lower printing speed and the downstream transfer cylinder has a device for accelerating a sheet from the printing speed to a higher machine speed. The transfer cylinders need not be disposed directly, i.e. immediately upstream and downstream of the respective printing cylinder. In addition to the printing cylinder, further cylinders may be provided that are likewise moved at the lower printing speed, for instance a drying cylinder for holding and drying a printed sheet may be disposed between the printing cylinder and the downstream transfer cylinder.

Such a printing unit allows the sheets to be transported at a lower speed during the printing process, ensuring a high print quality. In order to compensate for the reduced speed of the sheets on the printing cylinder, the spacing between the sheets on the printing cylinder is reduced, i.e. the interspaces between two sheets on the printing cylinder are shortened. If the printing cylinder has gaps that separate the sheet-holding areas of the printing cylinders from each other, the gaps are narrowed, i.e. their extension on the circumference of the printing cylinder is reduced.

That is to say that the printing performance of a printing unit of this type is advantageously increased by reducing print head dead times in which no printing may take place because there is no sheet underneath the print head.

In accordance with a particularly advantageous and thus preferred further development of the printing unit of the invention, the device for decelerating and the device for accelerating each include at least one gripper bar that is movable in a substantially radial direction in terms of the transfer cylinder, the gripper bar including grippers for holding and transferring sheets, wherein the gripper bar is decelerateable from the machine speed to the printing speed and acceleratable from the printing speed to the machine speed. Although the transfer cylinder rotates at a constant rotational speed, the speed change of the gripper bar and thus the speed change of a sheet results from the fact that the radius on which the gripper bar rotates is changeable. In other words: while the angular speed/rotational speed of the transfer cylinder remain the same, only the tangential speed of the gripper bar and thus the tangential speed of a respective sheet change.

In a preferred further development, the device for decelerating and the device for accelerating each include a cam mechanism to actuate the gripper bars. By using the cam mechanism, the gripper bars may be moved in a substantially radial direction.

In a preferred further development of this printing unit, a respective gripper bar of the transfer cylinders is supported on the respective transfer cylinder by using at least one pivot joint, for instance disposed on an end of the gripper bar and in particular embodied as a four-bar linkage. Such four-bar linkages are deemed to be particularly robust and allow a substantially radial displacement of the gripper bars.

In an alternative embodiment of the printing unit of the invention, the device for decelerating and the device for accelerating each include a rotary drive for changing the rotational speed of the transfer cylinders. In a further embodiment, the device for decelerating and the device for accelerating each include at least one rocker with a gripper bar fixed thereto, the gripper bar including grippers for holding and transferring sheets, wherein the rocker carries out a controlled movement relative to the transfer cylinder, i.e. the movement of the rocker superposes a decelerating or accelerating movement to the constant rotational speed of the transfer cylinder, allowing a sheet held by the grippers to be accelerated and decelerated.

In a particularly advantageous and thus preferred further development of the printing unit of the invention, the printing cylinder includes a plurality of sheet-holding areas, allowing multiple sheets to be simultaneously transported on the printing cylinder. The cylinder is in particular a ⅕-revolution cylinder with five sheet-holding areas. Small gaps separating the sheet-holding areas from one another are provided between every two sheet-holding areas.

With the objects of the invention in view, there is also provided a sheet-fed printing machine including a printing unit as described above.

The printing machine may be a digital printing machine, in particular including inkjet heads disposed at a distance from and above the printing cylinder.

Combinations of the invention as described and the advantageous further developments of the invention described above inasmuch as they make sense from a technical point of view also represent advantageous further developments of the invention.

Other features which are considered as characteristic for the invention are set forth in the appended claims.

Although the invention is illustrated and described herein as embodied in a sheet-fed printing machine and a printing unit in a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
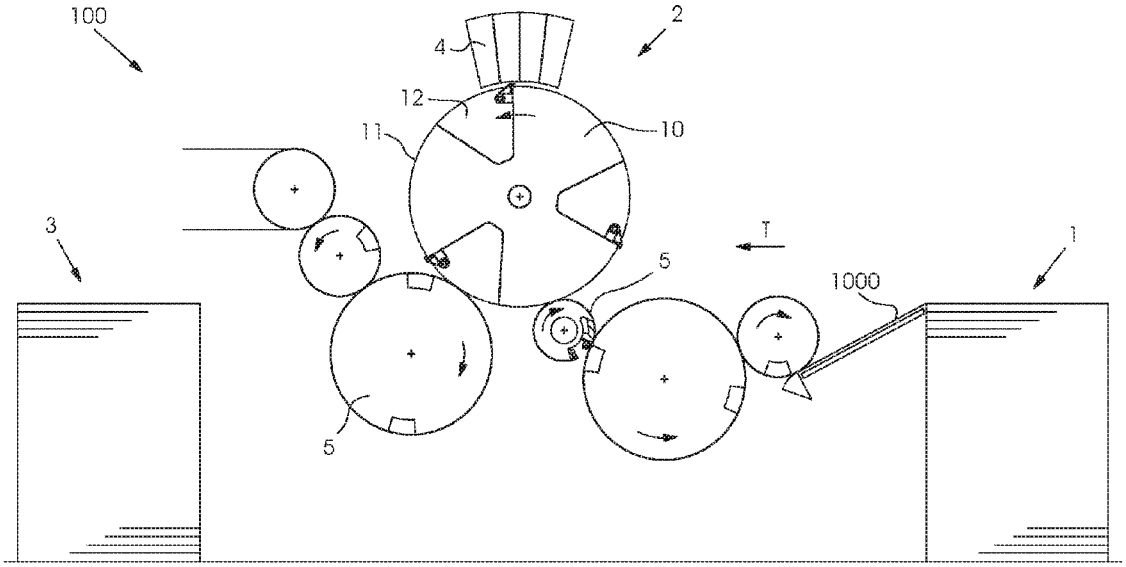
FIG. 1 is a diagrammatic, longitudinal-sectional view of a digital printing press.

Referring now in detail to the figures of the drawings, which are not drawn to scale and in which corresponding elements and components bear the same reference symbols, and first, particularly, to FIG. 1 thereof, there is seen a sheet-fed printing machine 100, which is embodied as a digital printing machine. A respective sheet 1000 coming from a feeder 1 is transported through a printing unit 2 to a delivery 3 in a direction of transport T. The transporting of a respective sheet 1000 is mainly carried out by using cylinders, namely a transfer cylinder 5 and a printing cylinder 10. Inkjet print heads 4 are disposed above the printing cylinder 10 to print on a sheet 1000 that is moved past at a short distance by using the printing cylinder 10. The printing cylinder 10 is thus also referred to as a jetting cylinder.

In the illustrated embodiment, the printing cylinder 10 includes three sheet-holding areas 11, which are separated from one another by a gap 12.

Figure 2:
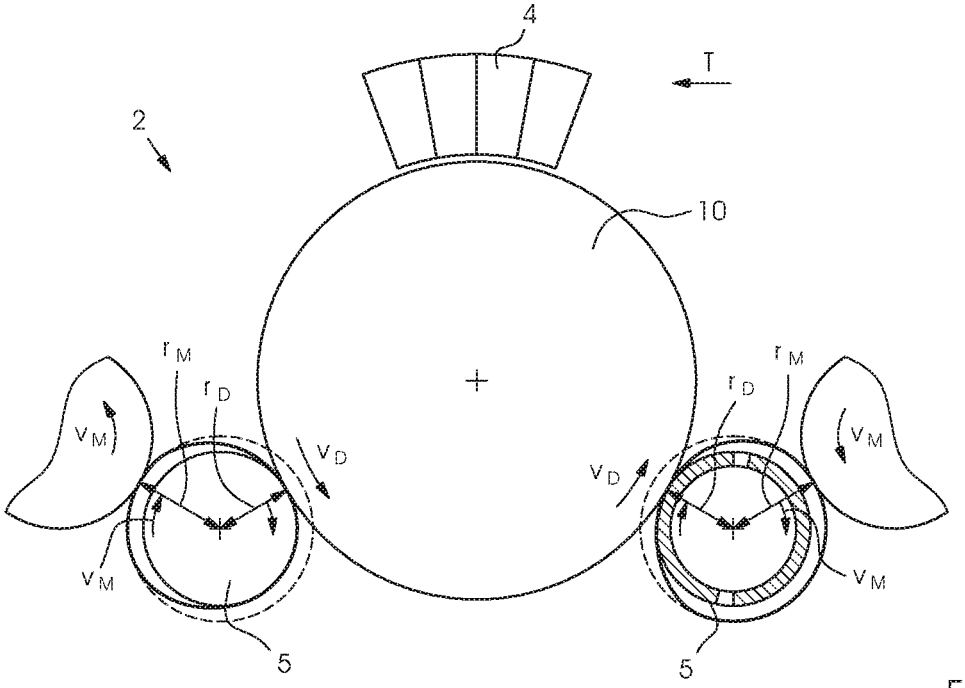
FIG. 2 is an end-elevational view of a printing unit of the invention in a digital printing press.

FIG. 2 illustrates a printing unit 2 of the invention. The printing unit 2 includes an upstream transfer cylinder 5, a printing cylinder 10 and a downstream transfer cylinder 5. Each one of the transfer cylinders 5 has a device 50 for decelerating/accelerating a sheet 1000. These devices 50, which are not illustrated in FIG. 2, will be shown in further figures and will be described below. Before it is transferred to the upstream transfer cylinder 5, a sheet 1000 is transported in the direction of transport T at a machine speed $v_M$. At this speed, the sheet 1000 is transferred to the transfer cylinder 5, which decelerates the sheet 1000 to a lower printing speed $v_D$. At this lower printing speed $v_D$, a respective sheet 1000 is then transferred to the printing cylinder 10 and moved underneath the inkjet heads 4 at the printing speed $v_D$, receiving the print. Then a respective sheet 1000 is transferred to the downstream transfer cylinder 5 at the printing speed $v_D$. The downstream transfer cylinder 5 reaccelerates the sheet 1000 to the machine speed $v_M$ and transports the sheet 1000 to potential downstream drying, varnishing and processing units at the high machine speed $v_M$.

The speed change of a respective sheet 1000 by using the devices 50 for accelerating and decelerating is achieved by a radial displacement of a gripper bar 51 having grippers 52 (shown in FIG. 3) while the transfer cylinder 5 rotates and the grippers 52 hold a sheet 1000. Thus the gripper bar 51 of an upstream transfer cylinder 5 is moved in a radial direction from a larger radius $r_M$ of the gripper bar to a smaller radius $r_D$. Since the device 50 for decelerating and the gripper bar 51 are fixed to the transfer cylinder 5 and since the latter continues to rotate at a constant rotational speed, this results in a reduction of the tangential speed of a respective sheet 1000, allowing a respective sheet 1000 to be transferred to the printing cylinder 10 at the lower speed $v_D$. Thus a greater number of sheets 1000 disposed at a smaller distance from one another may be transported and printed on the printing cylinder 10, for instance on 4 instead of 3 or on 5 instead of 4 sheet-holding areas 11. In an analogous way, a sheet 1000 taken over from the printing cylinder by the downstream transfer cylinder 5 is reaccelerated by the radial displacement of the gripper bar 51 from the smaller radius $r_D$ to the larger radius $r_M$. Due to the fact that the sheets 1000 are printed on at the lower printing speed $v_D$, a better resolution and a higher print quality are possible. Due to the reduced spacing between the sheets 1000 on the printing cylinder 10, the inkjet heads 4 operate more efficiently and have shorter dead times.

Figure 3:
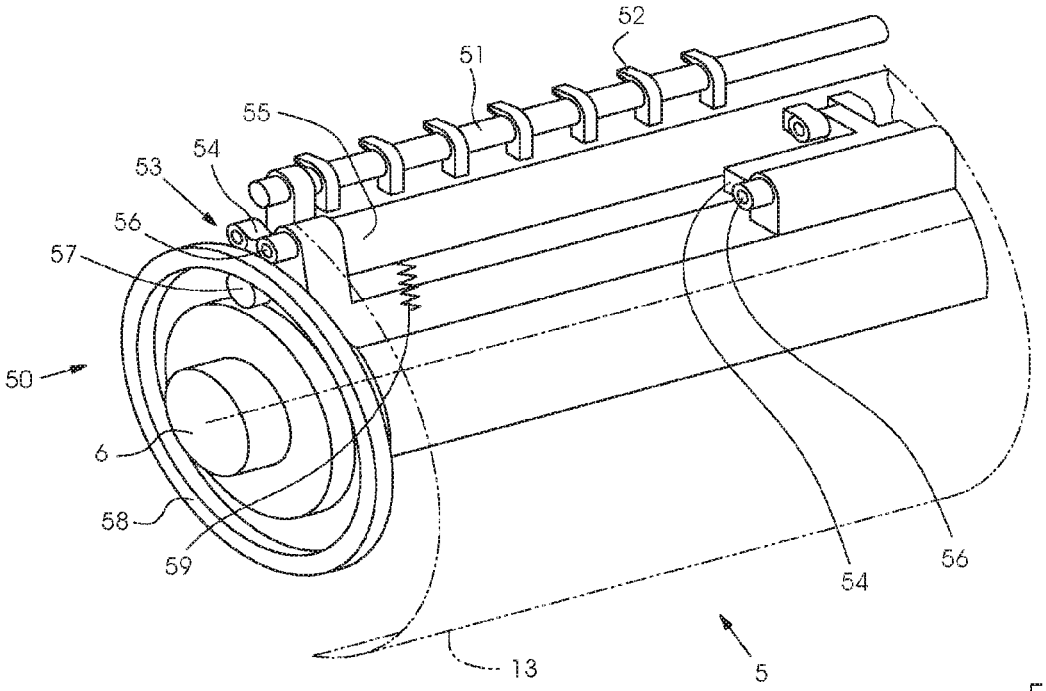
FIG. 3 is a perspective view of a transfer cylinder of the printing unit of FIG. 2.
Figure 4:
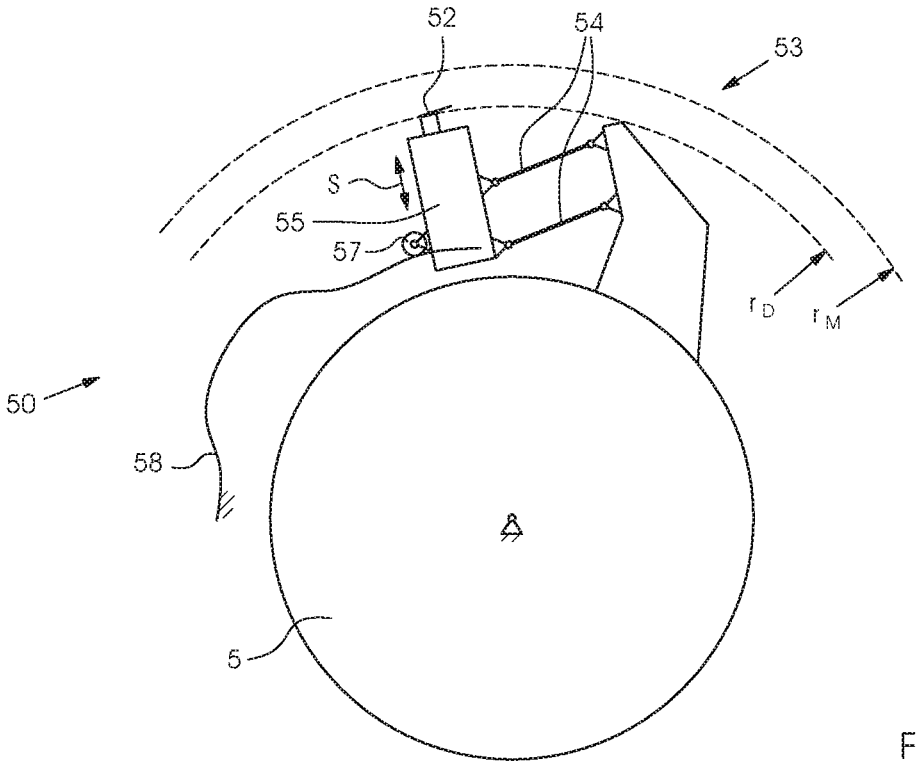
FIG. 4 is an end-elevational view of a portion of the transfer cylinder of FIG. 3.

The construction of the transfer cylinders 5 and of the devices 50 for decelerating and accelerating is shown in more detail in FIG. 3. A part of the device 50 for decelerating/accelerating is the gripper bar 51 extending over the width of the transfer cylinder 5 and having the grippers 52 fixed thereto. A respective sheet 1000 may be held by the grippers 52 and rests on a sheet-supporting area 13 of the transfer cylinder 5. The transfer cylinder 5 is driven by a drive 6, which may be embodied as a gearwheel integrated into the gear train of the drive of a sheet-fed printing machine 100. The radial displacement of the gripper bar 51 described with reference to FIG. 2 occurs with the aid of a four-bar linkage 53, namely by deflecting a connecting rod 55 of the four-bar linkage 53. The connecting rod 55 is supported in hinge points 56 on a base body of the transfer cylinder 5 by using rockers 54. The deflection of the connecting rod 55 to initiate the substantially radial displacement of the gripper bar 51 is achieved by a cam mechanism. A cam follower 57, which is fixed to the connecting rod 55, is moved along a stationary control cam 58 while the transfer cylinder 5 rotates. In this process, compression springs 59 ensure that the cam follower 57 is in continuous contact with the control cam 58. The construction of the four-bar linkage 53 for implementing a radial actuating movement s is shown more clearly in the detail view of FIG. 4. As is apparent from FIG. 3, the embodiment shown therein includes a divided four-bar linkage 53: first rockers 54 of the four-bar linkage are fixed to both the drive-side and the operator-side ends of the gripper bar 51. A second rocker 54 of the four-bar linkage 53 is disposed centrally.

Figure 5:
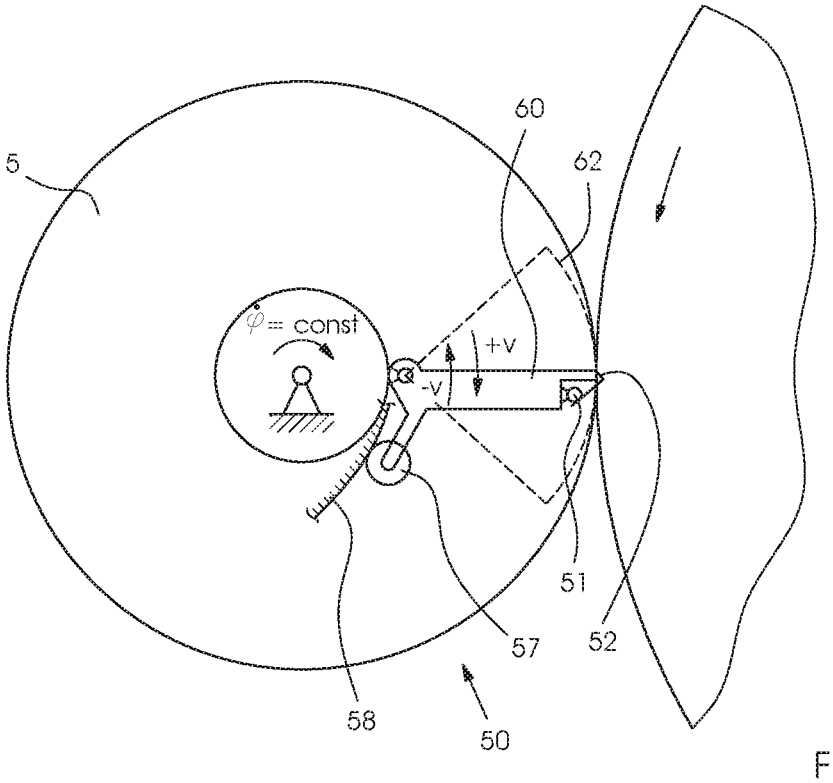
FIG. 5 is an end-elevational view of an alternative embodiment of the transfer cylinder.

FIG. 5 illustrates an alternative embodiment of the device 50 for decelerating/accelerating sheets 1000. In this case, the gripper bar 51 including grippers 52 for holding a respective sheet 1000 is not constructed to be radially displaceable. Instead, the gripper bar 51 is disposed on a rocker 60. The rocker 60 is supported to pivot on the base body of the transfer cylinder 5. While the transfer cylinder 5 rotates at a constant rotational speed, the rocker 60 carries out a pivoting movement in a pivoting area 62, causing a speed component v to be superposed on the constant rotational speed $\phi$ of the transfer cylinder 5 and the gripper bar 51 to be accelerated or decelerated. The pivoting movement of the rocker 60 is initiated by a cam mechanism 57, 58. A cam follower 57 rolling off on a stationary control cam 58 during the rotation of the transfer cylinder is disposed on the rocker 60.

The invention claimed is:

1. A printing unit in a sheet-fed printing machine, the printing unit comprising:

a printing cylinder;

a transfer cylinder disposed upstream of said printing cylinder in a sheet transport direction, said upstream transfer cylinder having a device for decelerating a sheet from a higher machine sheet speed to a lower printing sheet speed; and a transfer cylinder disposed downstream of said printing cylinder in the sheet transport direction, said downstream transfer cylinder having a device for accelerating a sheet from the lower printing sheet speed to the higher machine sheet speed.

2. The printing unit according to claim 1, wherein said device for decelerating a sheet and said device for accelerating a sheet each include at least one respective gripper bar being movable in a substantially radial direction.

3. The printing unit according to claim 2, wherein said device for decelerating a sheet and said device for accelerating a sheet each include a respective cam mechanism for actuating said respective gripper bar.

4. The printing unit according to claim 2, which further comprises at least one pivot joint supporting each respective gripper bar.

5. The printing unit according to claim 4, wherein said at least one pivot joint is a four-bar linkage.

6. The printing unit according to claim 1, wherein said device for decelerating a sheet and said device for accelerating a sheet each include a respective rotary drive for changing rotational speeds of a respective one of said transfer cylinders.

7. The printing unit according to claim 1, wherein said device for decelerating a sheet and said device for accelerating a sheet each include a respective rocker with a respective gripper bar fixed thereto, said rockers each carrying out a movement relative to a respective one of said transfer cylinders.

8. The printing unit according to claim 1, wherein said printing cylinder has a plurality of sheet-holding areas.

9. The printing unit according to claim 8, wherein said printing cylinder is a 1/5-revolution cylinder with five of said sheet-holding areas.

10. The printing unit according to claim 8, wherein each two respective sheet-holding areas have a respective gap there between.

11. A sheet-fed printing machine, comprising a printing unit according to claim 1.

12. The sheet-fed printing machine according to claim 11, wherein the printing machine is a digital printing machine.

13. The sheet-fed printing machine according to claim 12, which further comprises inkjet heads spaced apart from said printing cylinder.

14. The printing unit according to claim 1, wherein:

said device for decelerating a sheet decelerates a sheet already disposed on said upstream transfer cylinder; and said device for accelerating a sheet accelerates a sheet already disposed on said downstream transfer cylinder.

15. The printing unit according to claim 1, wherein:

said device for decelerating a sheet decelerates a tangential speed of a sheet while maintaining an angular speed of said upstream transfer cylinder; and said device for accelerating a sheet accelerates a tangential speed of a sheet while maintaining an angular speed of said downstream transfer cylinder.

* * * * *